US006505830B2

(12) United States Patent
Kang

(10) Patent No.: US 6,505,830 B2
(45) Date of Patent: Jan. 14, 2003

(54) OUTPUT PAPER STACKING DEVICE OF A PRINTING APPARATUS AND METHOD FOR COMPLETING THE SAME

(75) Inventor: Il-Kwon Kang, Suwon (KR)

(73) Assignee: Samsung Electronics Co., Ltd., Kyungki-do (KR)

( * ) Notice: Subject to any disclaimer, the term of this patent is extended or adjusted under 35 U.S.C. 154(b) by 92 days.

(21) Appl. No.: 09/794,400

(22) Filed: Feb. 28, 2001

(65) Prior Publication Data

US 2002/0017754 A1 Feb. 14, 2002

(30) Foreign Application Priority Data

Aug. 10, 2000 (KR) ..... 00-46344

(51) Int. Cl.[7] ..... B65H 3/66
(52) U.S. Cl. ..... 271/223
(58) Field of Search ..... 271/223; 399/405; 144/171

(56) References Cited

U.S. PATENT DOCUMENTS 5,280,897 A * 1/1994 Maekawa ..... 271/207
5,988,621 A * 11/1999 Kondo et al. ..... 271/171

FOREIGN PATENT DOCUMENTS

JP 58-52142 * 3/1983 ..... B65H/31/02
JP 11-193142 * 7/1999 ..... B65H/3/66

OTHER PUBLICATIONS

Littman, Dan "The Paper Chase", PCWORLD, vol. 18, Issue 6.*

* cited by examiner

*Primary Examiner*—Donald P. Walsh
*Assistant Examiner*—Kenneth W Bower
(74) *Attorney, Agent, or Firm*—Sughrue Mion, PLLC

(57) ABSTRACT

An output paper stacking device includes a tray installed at a position lower than a paper discharge opening of a printing apparatus so that printed paper sheets discharged through the discharge opening can stack sequentially. Guide levers are installed to project upward through respective through slots provided in the tray for guiding both sides of the printed paper sheet, and for aligning the paper sheet at a predetermined position. A supporting unit for rotatably supporting the guide levers is provided so that one end of each guide lever can be balanced by another end of the guide lever in a state in which one end of the guide lever projects upward through the through slot of the tray. Thus, the output paper stacking device according to the present invention guides and aligns a paper sheet with guide levers having simple structures and which do not require any external driving power.

7 Claims, 7 Drawing Sheets

OUTPUT PAPER STACKING DEVICE OF A PRINTING APPARATUS AND METHOD FOR COMPLETING THE SAME

BACKGROUND OF THE INVENTION

1. Field of the Invention

The present invention relates to an output paper stacking device of a printing apparatus and, more particularly, to an output paper stacking device of a printing apparatus which has an improved structure for aligning discharged output paper sheets.

2. Description of the Related Art

In general, a printing apparatus 10 such as a printer or copier is provided with a tray 12 as an output paper stacking device for stacking paper sheets discharged through a paper discharge opening 11, as shown in FIG. 1. That is, paper sheets discharged from the printing apparatus 10 by discharge rollers 13 stack on the tray 12 sequentially, and a user must arrange the discharged sheets before taking and using them for their intended purpose after a printing job. Therefore, a pivoting bar 14 as shown in FIG. 1 is used in addition to the output paper stacking device for automatically aligning the sheets since aligning the paper sheets is very troublesome whenever a printing operation is performed. The pivoting bar 14 is driven by a driving unit (not shown) installed in the printing apparatus 10, and is pivoted along an arc track shown in FIG. 1. When the pivoting bar 14 is pivoted as described above, the pivoting bar 14 pushes the paper sheets stacked on the tray 12 toward one side wall 12*a* of the tray 12. Therefore, since the discharged paper sheets are stacked while they are continually aligned with each other with respect to the one side wall 12*a* when the pivoting bar 14 is pivoted, there is no need for additionally aligning the paper sheets afterward.

However, when employing the above pivoting bar 14, there are disadvantages in that the number of parts increases, and the structure of the discharge opening 11 side is very complex since a driving unit for driving the pivoting bar 14 must be installed in the printing apparatus 10, and also a sensor for detecting the completion of discharging a paper sheet must be installed. In addition, since the pivoting bar 14 is pivoted whenever a paper sheet is discharged, the consumption of energy for a printing operation increases.

Therefore, an output paper stacking device having a simpler structure adapted to stack discharged paper sheets while aligning the paper sheets is required.

SUMMARY OF THE INVENTION

To solve the above problems, it is an objective of the present invention to provide an output paper or printable medium stacking device of a printing apparatus having a simple structure and method which is improved to align the output paper sheets with each other while not requiring an external driving power source, such as an electric motor.

Accordingly, to achieve the above objective, there is provided a printable medium stacking device of a printing apparatus comprising: a tray installed at a position lower than a discharge opening of a printing apparatus so that a printable medium discharged through the discharge opening can stack sequentially. Guide levers are installed so that respective first ends thereof are operative to project upward through respective through slots provided in the tray. The first ends of the guide levers guide both sides of the printable medium discharged from the discharge opening, and align the printable medium at a predetermined position with the respective first ends thereof. Supporting means for rotatably supporting the guide levers are also provided so that the first end of each respective guide lever is balanced by a second end of the guide lever in a state in which the first ends of the guide levers project upward through the through slots of the tray.

The invention also contemplates a method of stacking a printable medium onto a tray after the printable medium is processed by a printing apparatus. The method includes: discharging the printable medium from the printing apparatus and rotatably balancing a first pair of guide levers and at least a second pair of guide levers, the second pair of guide levers having a width that is greater than a width of the first pair of guide levers, and guiding the printable medium between one of the first pair and at least the second pair of guide levers. When the printable medium is guided between the second pair of guide levers, the method further includes depressing the first pair of guide levers into a surface of the tray.

BRIEF DESCRIPTION OF THE DRAWINGS

The above objective and advantages of the present invention will become more apparent by describing in detail preferred embodiments thereof with reference to the attached drawings, in which.

DETAILED DESCRIPTION OF THE PREFERRED EMBODIMENTS

Figure 1:
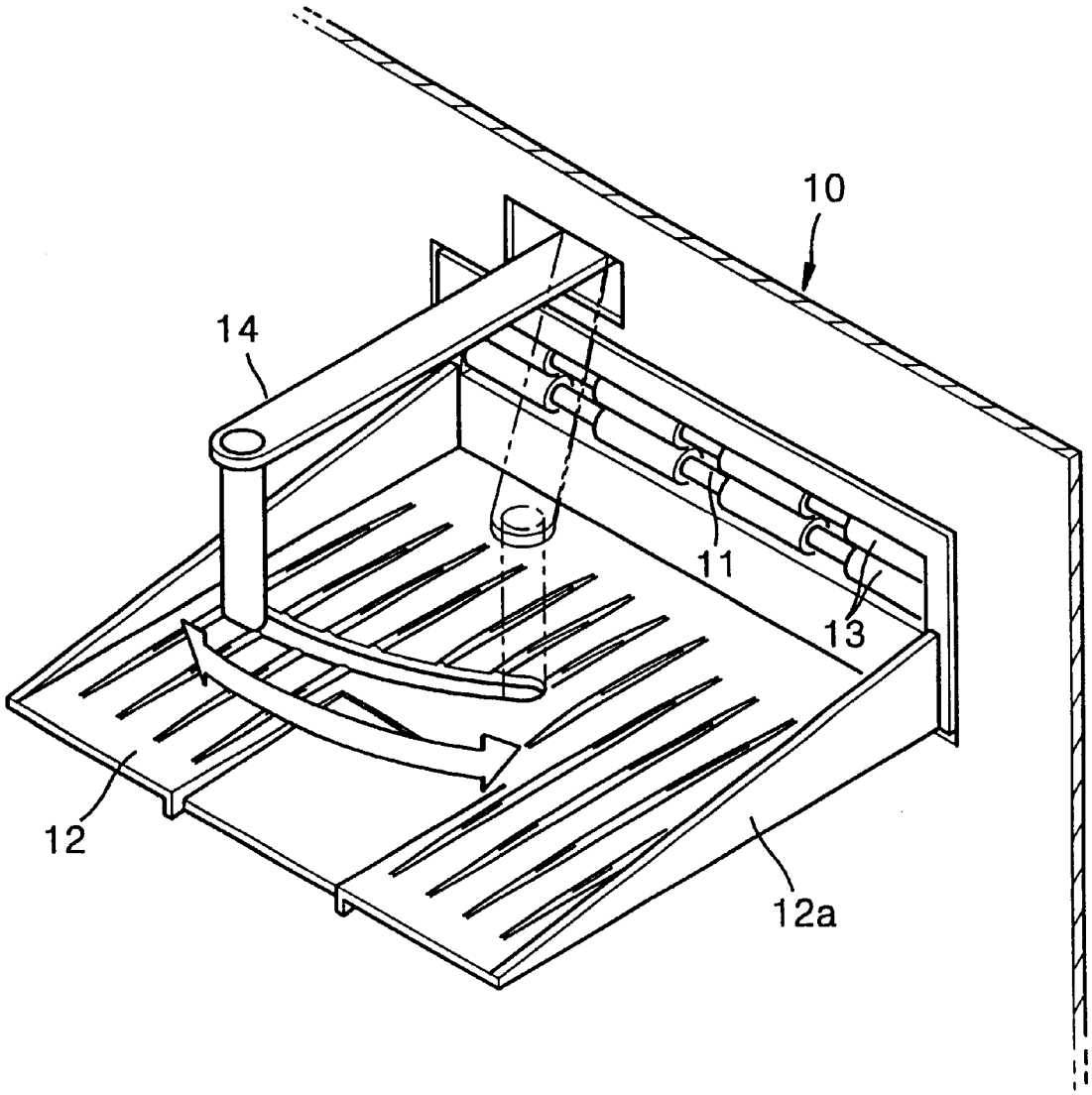
FIG. 1 (PRIOR ART)
FIG. 1 is a perspective view illustrating a conventional output paper stacking device of a printing apparatus.
Figure 2:
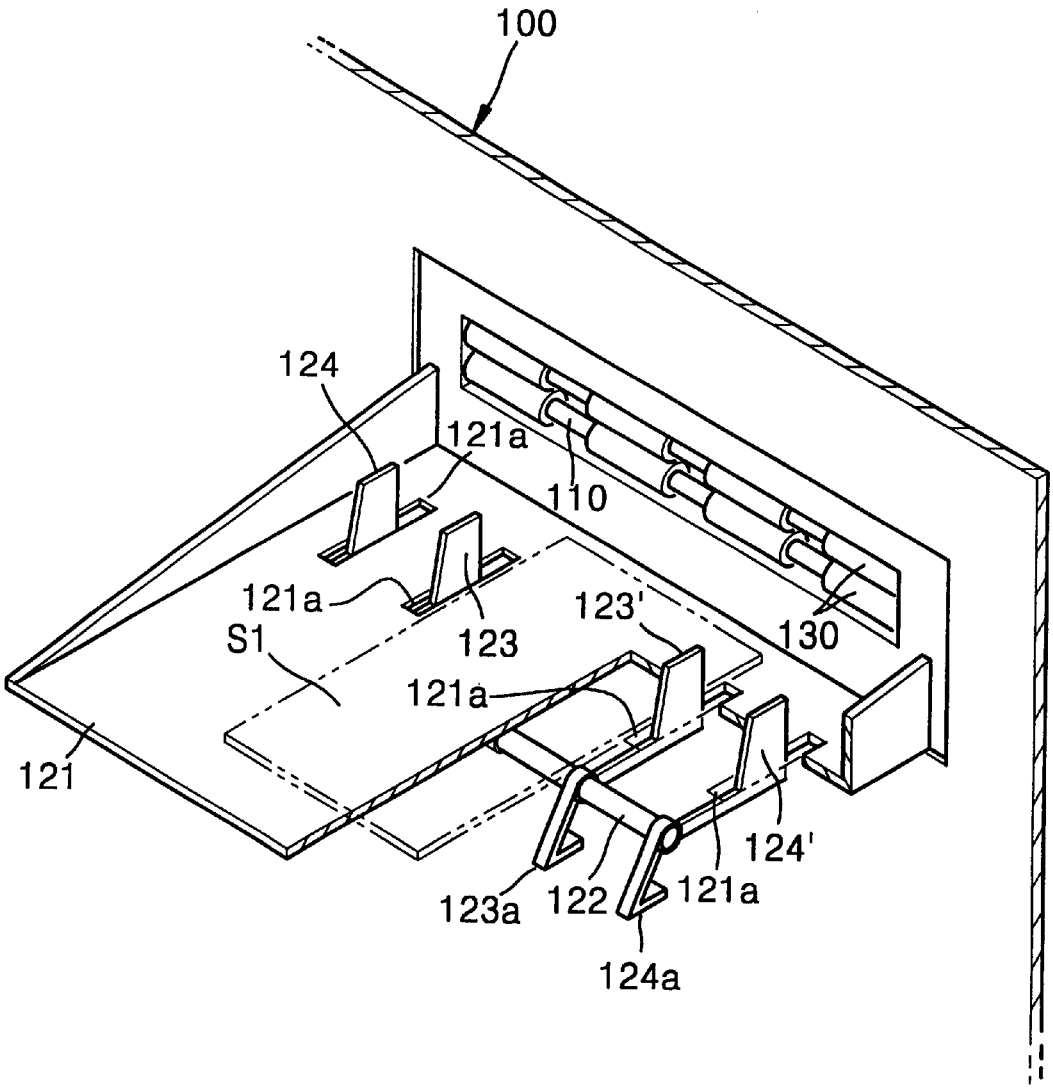
FIGS. 2 and 3 are perspective views illustrating an output paper stacking device of a printing apparatus according to a first embodiment of the present invention.
Figure 3:
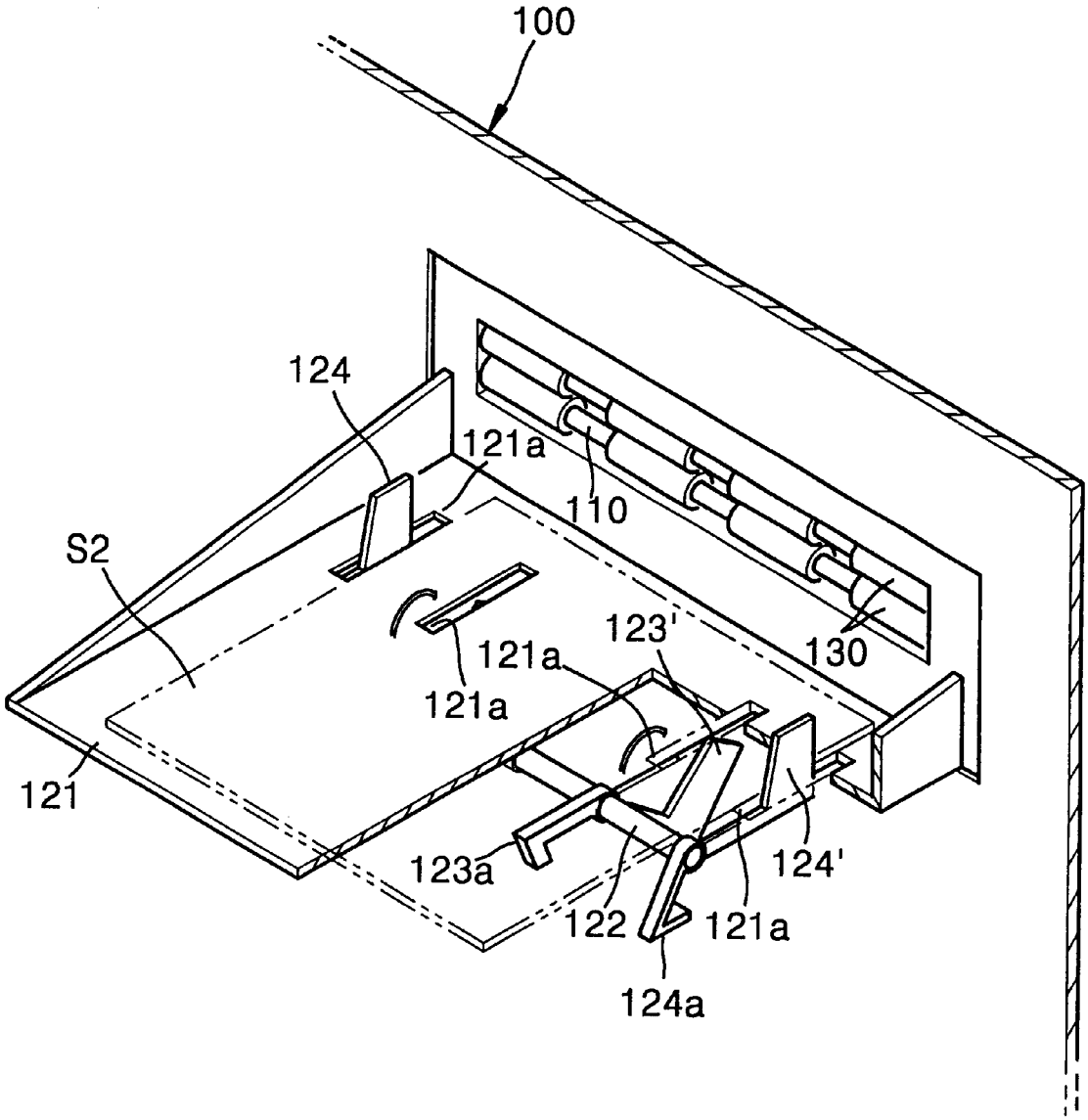

FIGS. 2 and 3 show an output paper stacking device of a printing apparatus according to a first embodiment of the present invention.

As shown in FIGS. 2 and 3, an output paper stacking device according to this embodiment includes a tray 121 which is installed at a position lower than a discharge opening 110 of a printing apparatus 100, and on which a printable medium, such as paper sheets are discharged to, from the discharge opening 110, and stacked sequentially. In addition, the output paper stacking device is provided with guide levers 123, 123', 124 and 124', and ends of the guide levers 123, 123', 124 and 124' project upward through respective through slots 121*a* formed in the tray 121. The guide levers 123, 123', 124 and 124' are rotatably supported by a shaft 122 provided under a lower surface of the tray 121, and counterbalances 123*a* and 124*a* are integrally provided at other ends of the guide levers 123, 123', 124 and 124' for balancing the guide levers 123, 123', 124 and 124'. The guide levers 123, 123', 124 and 124' are balanced by the counterbalances 123*a* and 124*a* in a state in which the guide levers 123, 123', 124 and 124' project upward through the respective through slots 121*a* formed at the tray 121. Therefore, even though the guide levers 123, 123', 124 and 124' are intentionally pressed down through the respective through slots 121*a*, when an externally applied force is removed, the guide levers 123, 123', 124 and 124' are brought back to their original positions by the counterbalances 123*a* and 124*a*. However, whenever a load is applied to the guide levers 123, 123', 124 and 124', the guide levers 123, 123', 124 and 124' are pivoted downward through the respective through slots 121*a*. The guide levers 123 and 123' form an inner pair of guide levers and are intended to be used when paper sheets of a smaller size are discharged, and the guide levers 124 and 124' form an outer pair of guide levers and are intended to be used when paper sheets of a larger size are discharged. That is, the distances between the two pairs of guide levers 123, 123', 124 and 124' are set to correspond to widths of the respective sheets of predetermined sized paper. Therefore, any one pair of the two pairs of guide levers, corresponding to the width of the printed paper sheets, guides the printed paper sheets to a predetermined stacking position one by one, and causes the printed sheets to stack in an aligned manner. Reference numeral 130 denotes a paper discharging roller for discharging printed paper sheets one by one through the paper discharge opening 110.

In the above structure, when a paper sheet S1 of a smaller size is printed, and before the printed paper sheet is discharged from the printing apparatus 100, the two pairs of guide levers 123, 123', 124 and 124' project upward through the through slots of the tray 121 and are maintained in equilibrium states, as shown in FIG. 2. In this state, when a printed paper sheet S1 is discharged through the paper discharge opening 110, both sides of the printed sheet S1 are guided between the inner guide levers 123 and 123' of the guide levers 123, 123', 124 and 124', and the printed paper sheet S1 is seated on the tray 121. Since all the printed paper sheets S1 discharged from the paper discharge opening 110 of the printing apparatus 100 are guided between the projected ends of the guide levers 123 and 123', and are seated on the tray 121, the printed paper sheets are always maintained in an evenly aligned state.

In addition, when a printed paper sheet S2 of a larger size is discharged from the printing apparatus 100, the outer guide levers 124 and 124' guide the printed paper sheet S2, as shown in FIG. 3. That is, when a printed paper sheet S2 of a larger size is discharged through the paper discharge opening 110, both sides of the printed sheet S2 are guided between the outer guide levers 124 and 124', and the printed sheet S2 is seated on the tray 121 in an evenly aligned state. At this time, when the printed paper sheet S2 is laid on the tray 121, the inner guide levers 123 and 123' are pressed downward by a weight of the printed paper sheet S2, and are moved down through the through slots 121*a*. That is, the inner guide levers 123 and 123' are naturally moved down through the through slots 121*a* by a weight of the printed paper sheet S2, without performing a separate operation in order to move down the guide levers 123 and 123' through the through slots 121*a*.

As described above, the output paper stacking device according to the present invention can evenly align printed paper sheets by guiding each of the printed paper sheets with guide levers corresponding to a paper sheet size without using driving power at all.

Figure 4:
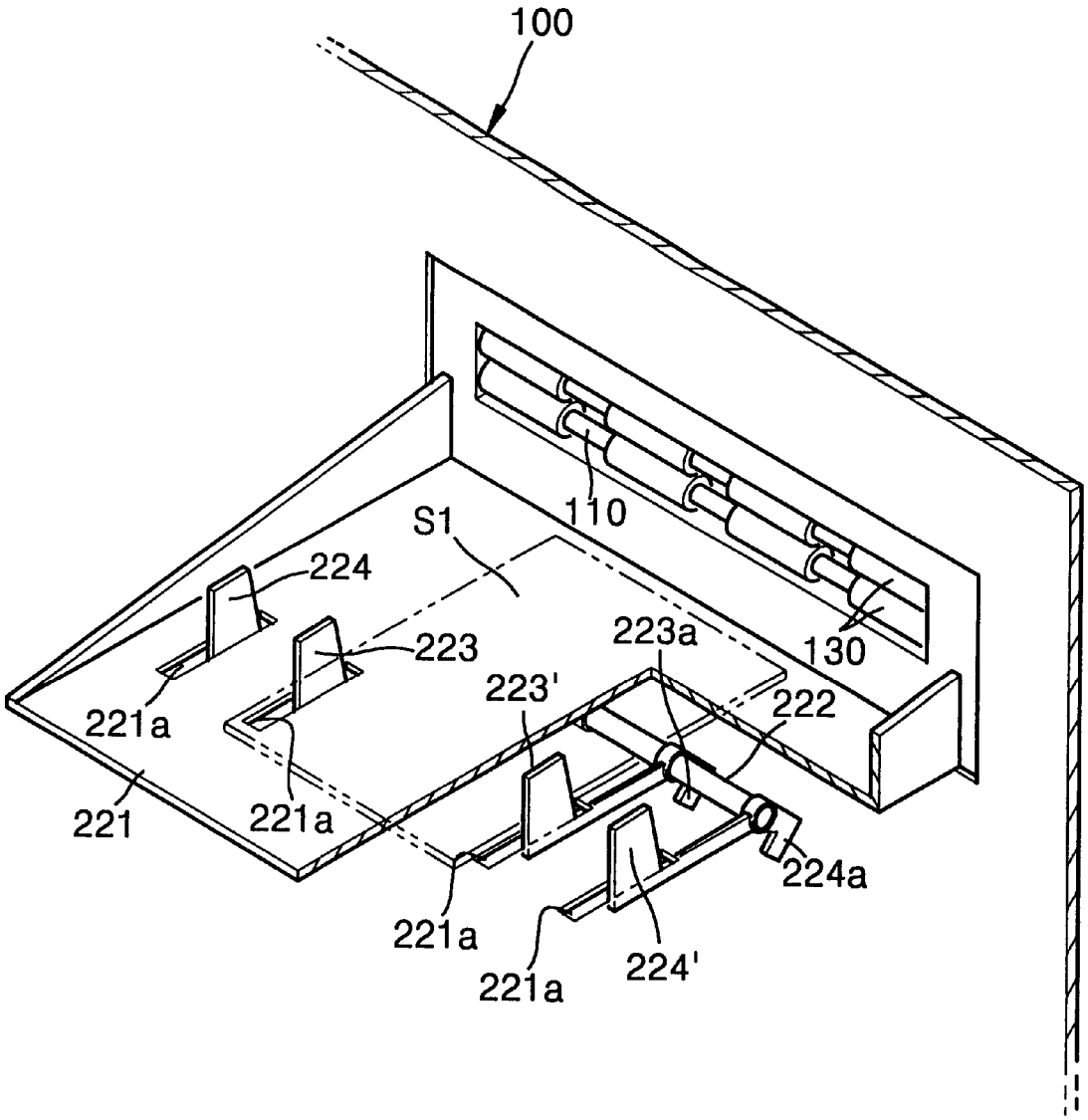
FIGS. 4 and 5 are perspective views illustrating an output paper stacking device of a printing apparatus according to a second embodiment of the present invention.
Figure 5:
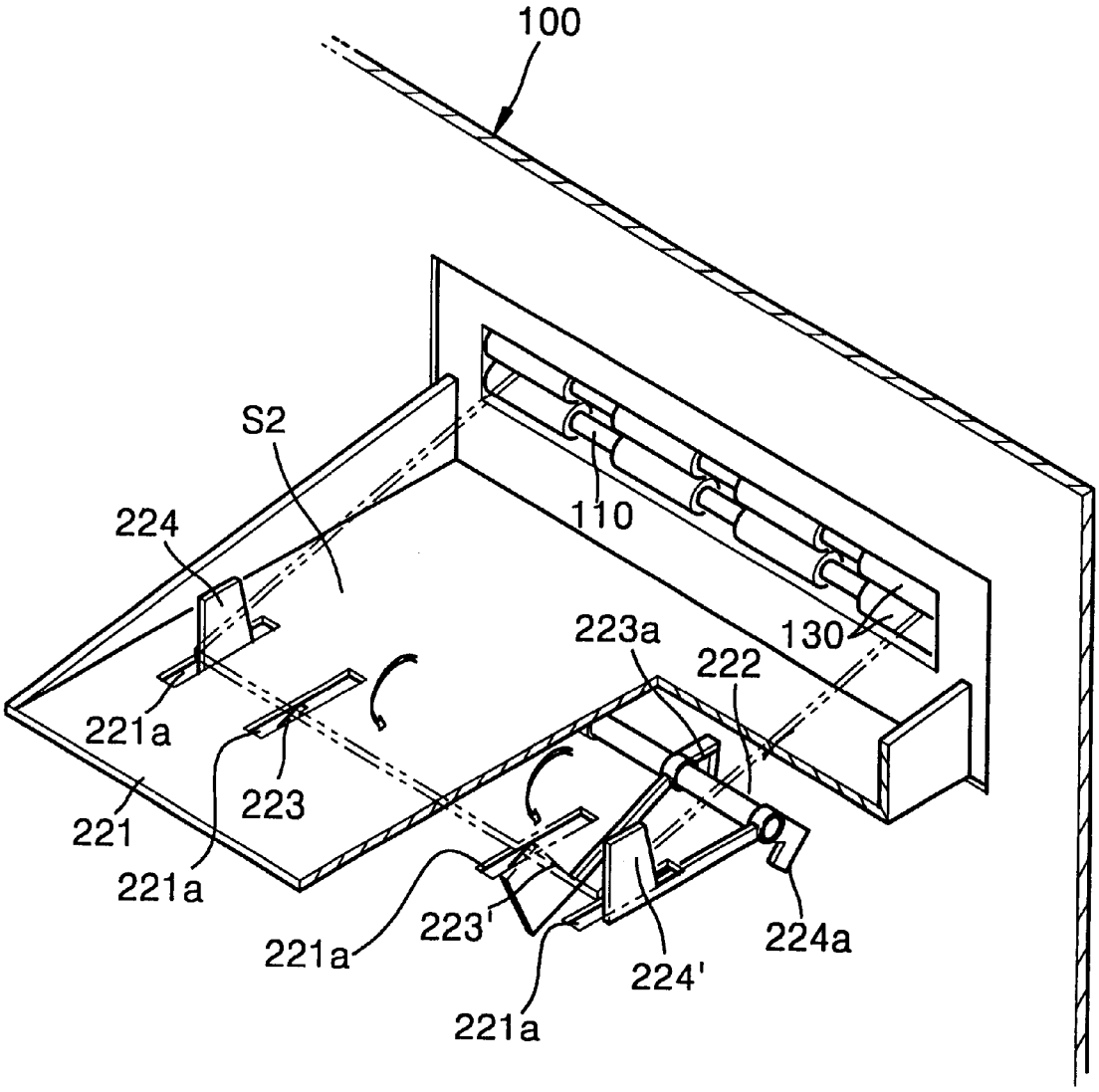

Next, FIGS. 4 and 5 show another output paper stacking device according to a second embodiment of the present invention.

This embodiment basically has the same structure as the above first embodiment. However, the second embodiment is different from the first one in the fact that respective parts of guide levers 223, 223', 224 and 224' and counterbalances 223*a* and 224*a*, which are rotatably supported on a shaft 222, are disposed in a direction opposite to that of the first embodiment. Here, the guide levers 223, 223', 224 and 224' are similarly balanced by the counterbalances 223*a* and 224*a* while projecting upward through respective through slots 221*a* of a tray 221.

In the above structure, when a paper sheet S1 of a smaller size is printed and before the printed paper sheet is discharged from a printing apparatus 100, the two pair of guide levers 223, 223', 224 and 224' project upward through the through slots of the tray 221 and are maintained in equilibrium states, as shown in FIG. 4. In this state, when a printed paper sheet S1 is discharged through a paper discharge opening 110, both sides of the printed sheet S1 are guided between the inner guide levers 223 and 223', and the printed paper sheet S1 is seated on the tray 221.

In addition, when a printed paper sheet S2 of a larger size is discharged from the printing apparatus 100, the outer guide levers 224 and 224' guide the printed paper sheet S2, as shown in FIG. 5. That is, when a printed paper sheet S2 of a larger size is discharged through the paper discharge opening 110, both sides of the printed sheet S2 are guided between the outer guide levers 224 and 224', and the printed sheet S2 is seated on the tray 221 in an evenly aligned state. At this time, the inner guide levers 223 and 223' are pushed by the leading edge of a printed paper sheet S2 discharged from the paper discharge opening and are moved down through the through slots 221*a*. As a matter of course, even though the inner guide levers 223 and 223' are not completely moved down by the leading edge of the printed paper sheet S2, when the printed paper sheet S2 is laid on the tray 221, the inner guide levers 223 and 223' are moved down through the through slots 221*a* by a weight of the printed paper sheet S2. Therefore, it is found that even though the guide levers and the counterbalances are disposed in a direction opposite to that of the first embodiment, the guide levers 223, 223', 224 and 224' can smoothly guide and align the printed paper sheets one by one.

Figure 6:
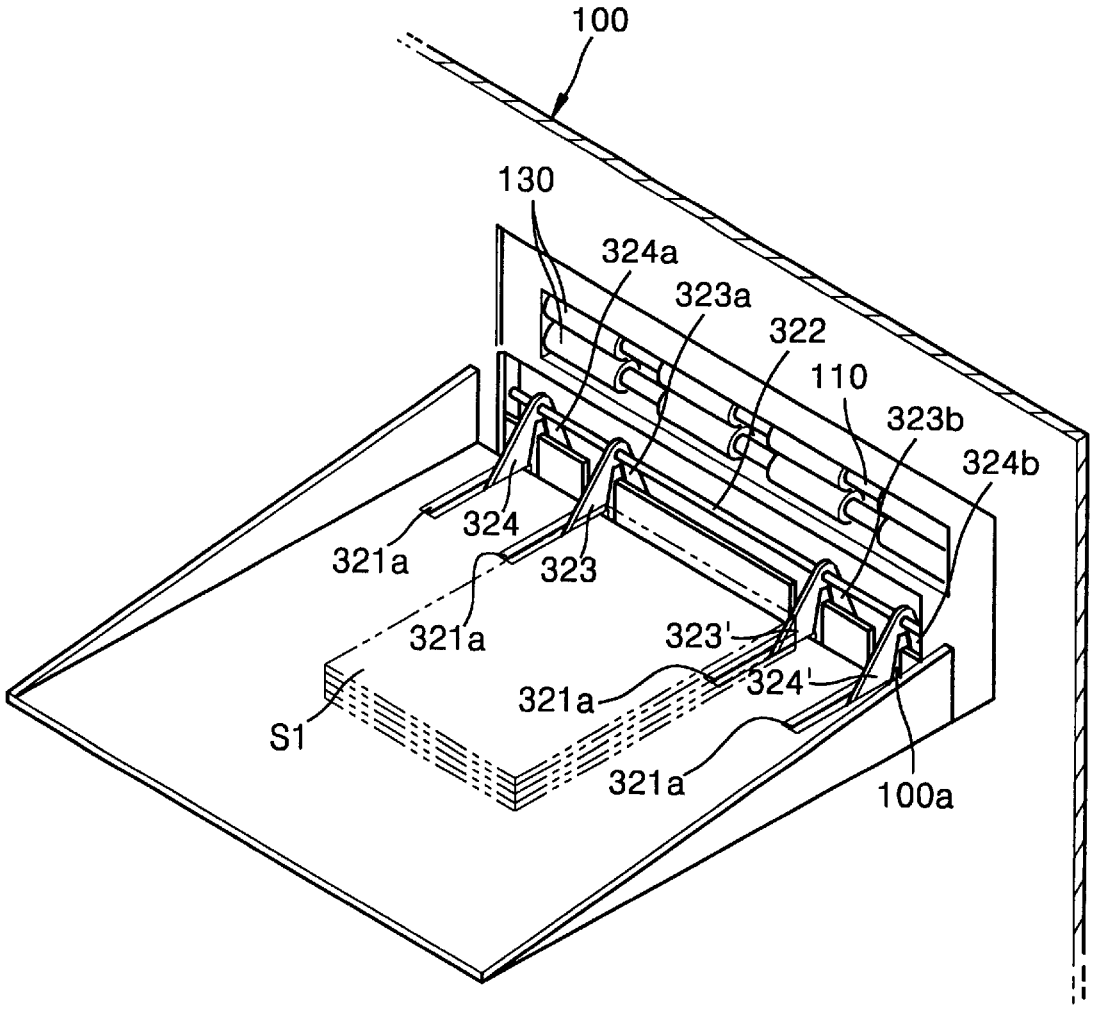
FIGS. 6 and 7 are perspective views illustrating an output paper stacking device of a printing apparatus according to a third embodiment of the present invention.
Figure 7:
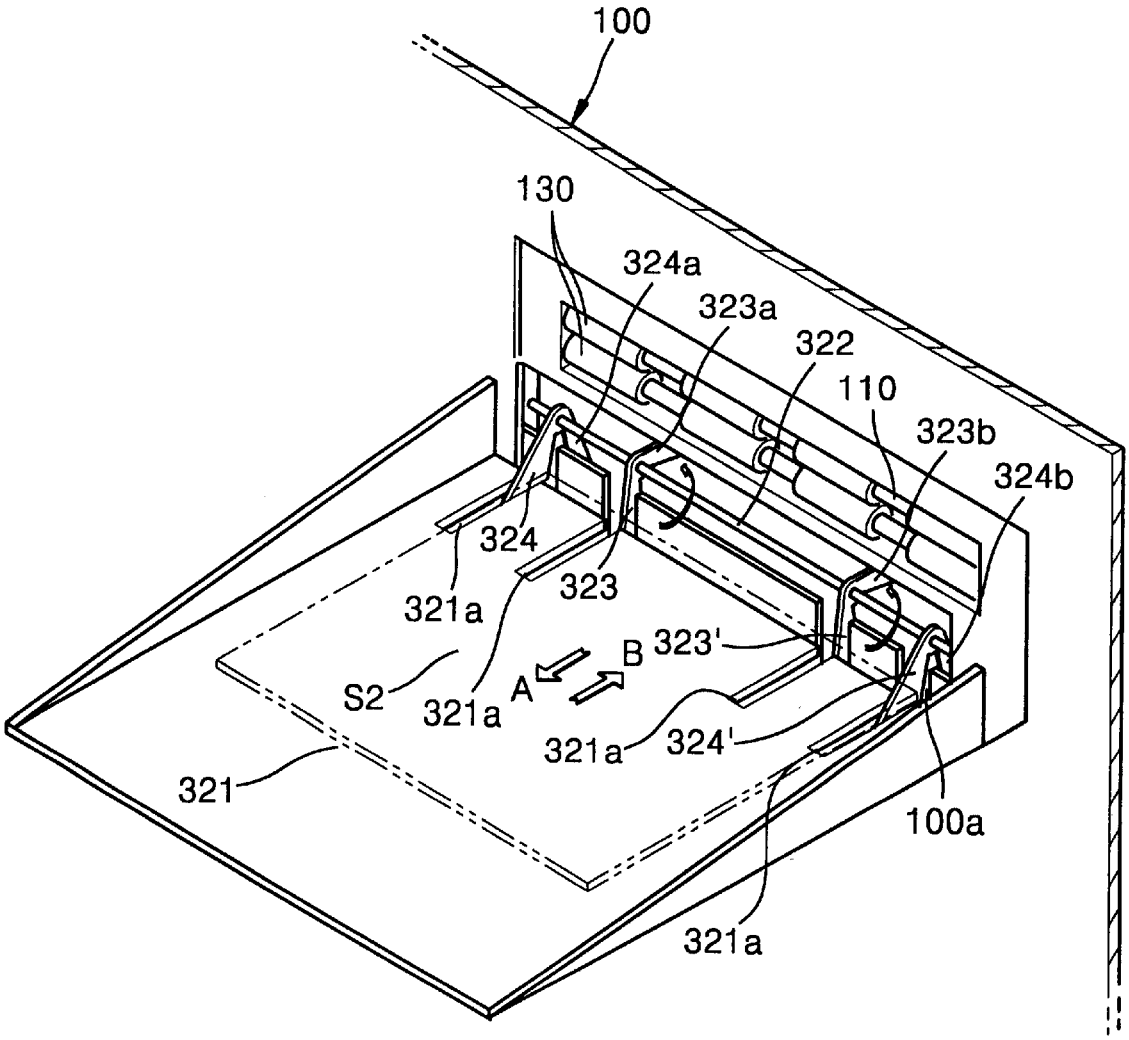

FIGS. 6 and 7 show still another output paper stacking device according to a third embodiment of the present invention.

This embodiment is different from the above embodiment in that a shaft for rotatably supporting respective pairs of guide levers 323, 323', 324 and 324' is installed in a printing apparatus 100, and counterbalances 323*a*, 323*b*, 324*a* and 324*b* for respectively balancing the guide levers 323, 323', 324 and 324' are also disposed in the printing apparatus 100. Therefore, the guide levers 323, 323', 324 and 324' which project through respective through slots 321*a* are configured to pivot from an inside to an outside of the printing apparatus 100 through respective through slots 321*a*. In addition, it is contemplated that the tray 321 has a slanted shape in which the paper discharge opening 110 side is lower than the opposite side so that printed paper sheets are prevented from falling to a floor. Therefore, a printed paper which is laid on the tray 321 slides down to the paper discharge opening 110 side to form a stack, and this embodiment is configured so that the inner guide lever 323 and 323' can be pivoted by this effect.

First, when a paper sheet S1 of a smaller size is discharged from the printing apparatus 100, both sides of the printed sheet S1 are guided between the inner guide levers 323 and 323', as shown in FIG. 6.

On the other hand, when a paper sheet S2 of a larger size is discharged from the printing apparatus 100, the outer guide levers 324 and 324' guide both sides of the printed sheet S2, as shown in FIG. 7. However, since the paper sheet S2 discharged from the paper discharge opening 110 is first moved in the direction of arrow A, and then slides in the direction of arrow B along the slanting bottom surface of the tray 321, the inner guide levers 323 and 323' are pressed by the rear end of the paper sheet sliding down in the direction of arrow B, and are pressed out to the outside of the tray 321. Therefore, the paper sheet S2 is guided by the outer guide levers 324 and 324', and stacked on the tray without being obstructed by the inner guide levers 323 and 323'.

Therefore, as described above, by variously disposing guide levers which have simple structures and are balanced by respective counterbalances, a printable medium, such as paper can be smoothly guided by the guide levers without using any driving power.

In addition, in the above embodiments, even though two types of paper sizes, that is, larger and smaller sizes, used in a printing apparatus are exemplified, it should be understood that more guide levers may be installed to correspond to different sizes of paper.

As described above, since an output paper stacking device according to the present invention guides and aligns a paper sheet discharged from a printing apparatus with guide levers having simple structures, the output paper stacking device can be simple, and since external driving power is not required, there is an effect in which overall energy consumption of a printing apparatus can be reduced.

It is contemplated that numerous modifications may be made to the apparatus and method of the present invention without departing from the spirit and scope of the invention as defined in the appended claims.

What is claimed is:

1. A printable medium output stacking device of a printing apparatus comprising:

a tray installed at a position lower than a discharge opening of the printing apparatus so that a printable medium discharged through the discharge opening can stack sequentially;

guide levers installed so that respective first ends thereof are operative to project upward through respective through slots provided in the tray to guide sides of the printable medium discharged from the discharge opening, and align the printable medium at a predetermined position with the respective first ends thereof; and supporting means for rotatably supporting the guide levers so that the first end of each respective guide lever is balanced by a second end of the guide lever in a state in which the first ends of the guide levers project upward through the through slots of the tray.

2. The printable medium output stacking device of a printing apparatus as claimed in claim 1, wherein the supporting means includes:

a shaft installed under the tray so that the guide levers can be rotatably supported on the shaft; and counterbalances respectively provided on the second ends of the guide levers which balance the respective guide levers so that each guide lever can be maintained in an equilibrium state in which the first end of each guide lever projects upward through the through slots of the tray.

3. The printable medium output stacking device of a printing apparatus as claimed in claim 1, wherein the supporting means includes:

a shaft installed in the printing apparatus which supports the guide levers so that the guide levers can individually pivot through the respective through slots formed at the printing apparatus; and counterbalances respectively provided on the second ends of the guide levers which balance the respective guide levers so that each guide lever can be maintained in an equilibrium state in which the first end of each guide lever projects upward through the through slots of the tray.

4. The printable medium output device of a printing apparatus as claimed in claim 1, wherein a plurality of guide levers are installed to correspond to different sized pieces of printable medium usable in the printer, two of the guide levers correspond to a first sized printable medium and are operative to guide sides of the first sized printable medium, and at least two other guide levers correspond to a second sized printable medium and are operative to guide sides of the second sized printable medium and have ends which are operative to be pressed down under the tray by one or more pieces of the first sized printable medium, which is larger than the second sized printable medium.

5. A printable medium output stacking device of a printing apparatus comprising:

a tray installed at a position lower than a discharge opening of the printing apparatus so that a printable medium discharged through the discharge opening can stack sequentially;

a plurality of guide levers installed so that respective first ends thereof are operative to project upward through respective through slots provided in the tray to guide both sides of the printable medium that is discharged from the discharge opening, and align the printable medium at a predetermined position with the respective first ends thereof;

a shaft installed under the tray so that the guide levers can be rotatably supported on the shaft; and counterbalances provided on a second end of at least one of the guide levers which balance the guide levers so that each guide lever can be maintained in an equilibrium state in which the first end of each guide lever projects upward through the through slots of the tray.

6. The printable medium output stacking device of a printing apparatus as claimed in claim 5, wherein the guide levers are positioned to form a first pair and at least one second pair, the first pair having a width which is less than a width of the at least one second pair, and at least one guide lever of the first pair and at least one guide lever of the second pair respectively have counterbalances positioned on a second end thereof.

7. A method of stacking a printable medium onto a tray after the printable medium is processed by a printing apparatus comprising:

discharging the printable medium from the printing apparatus;

rotatably balancing a first pair of guide levers and at least a second pair of guide levers, the second pair of guide levers having a width which is greater than a width of the first pair of guide levers; and guiding the printable medium between one of the first pair of guide levers and the second pair of guide levers, wherein when the printable medium is guided between the second pair of guide levers, the method further includes depressing the first pair of guide levers into a surface of the tray.

* * * * *